US007014619B2

(12) United States Patent
Scheib

(10) Patent No.: US 7,014,619 B2
(45) Date of Patent: Mar. 21, 2006

(54) MASSAGE DEVICE

(76) Inventor: Oliver Scheib, Talstrasse 55, 76889 Schweigen-Rechtenbach (DE)

( * ) Notice: Subject to any disclaimer, the term of this patent is extended or adjusted under 35 U.S.C. 154(b) by 268 days.

(21) Appl. No.: 10/349,494

(22) Filed: Jan. 22, 2003

(65) Prior Publication Data

US 2003/0144617 A1 Jul. 31, 2003

(30) Foreign Application Priority Data

Jan. 25, 2002 (DE) ..... 102 02 799

(51) Int. Cl.
*A61H 7/00* (2006.01)

(52) U.S. Cl. ..... 601/90; 601/95; 601/111; 601/134

(58) Field of Classification Search ..... 601/31, 601/89, 90, 91, 92, 93, 94, 95, 98, 99, 101, 601/103, 107, 108, 111, 133, 134, 136
See application file for complete search history.

(56) References Cited

U.S. PATENT DOCUMENTS

| | | | | |
|---|---|---|---|---|
| 1,999,412 | A | 4/1935 | Hardy | |
| 1,999,956 | A | 4/1935 | Chiles et al. | |
| 2,360,975 | A | 10/1944 | Petersen | |
| 3,424,149 | A | 1/1969 | Fujimoto | |
| 4,202,326 | A | 5/1980 | Van Gerpen | |
| 5,092,315 | A | 3/1992 | Bennett et al. | |
| 6,387,062 | B1 * | 5/2002 | Moore, Jr. | 601/98 |
| 6,475,171 | B1 * | 11/2002 | Williams | 601/98 |

FOREIGN PATENT DOCUMENTS

| | | |
|---|---|---|
| EP | 1330996 | 7/2003 |

* cited by examiner

*Primary Examiner*—Quang D. Thanh
(74) *Attorney, Agent, or Firm*—Egbert Law Offices

(57) ABSTRACT

The invention involves a massage device with moving massage cams. In order to achieve an especially good massaging kneading action of the cams, it is proposed here to provide the massage cams on the ends of oscillating rockers, which are arranged in at least one pair and next to each other, and which can be driven offset in phase from each other.

5 Claims, 4 Drawing Sheets

MASSAGE DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention involves a massage device with moving massage cams.

BACKGROUND OF THE INVENTION

Massage devices of this type are known in the prior art, in the form of hand-operated devices, for example. In these known devices of this type, the cams are arranged on a disc (or plate), which can be set in motion in vibrations or slight oscillations. These vibrations or oscillations are transferred via cams to the body part that is to be massaged and thus produce a certain massaging action.

This massaging action is relatively limited in its effectiveness, however, and in particular, it does not cause any real relaxation that goes deep into muscle tissue.

From this perspective, the purpose of the invention is to provide a massage device that produces a massaging action that goes deeper into muscle tissue.

BRIEF SUMMARY OF THE INVENTION

This purpose is achieved according to the invention in that the massage cams are located on the ends of oscillating rockers, which are arranged in at least one pair and next to each other, and which can be driven offset in phase from each other.

The invention has the advantage that via the phase-shifted drive of the oscillating rockers, the massage cams are moved towards each other and away from each other. The tissue that is treated with the massage device is thus not only relaxed by vibrations but also the massaging action is achieved by a pressing together and stretching of the tissue between the massage cams. This produces action at considerably larger depth to achieve the desired relaxation of tissue and/or muscle tension.

It has proven to be especially favorable in the process to design the oscillating rockers essentially in a U-shape, whereby the massage cams then are arranged at the ends of the legs of the U-shaped oscillating rockers. In this way, a continuous kneading of tissue with a corresponding deep relaxation action can be achieved.

Especially in that the oscillating rockers are driven continuously oscillating via eccentric shafts, a uniform, non-jerky operation of the massage device is obtained, whereby an especially good massage effect is achieved, which is felt to be pleasant by a person to be massaged.

In parallel to the eccentric shaft, a guide for the oscillating rockers is provided which contributes to the stability of the device. In particular, this guide functions for the purpose, however, of guiding the oscillating rockers. The stability can also be achieved, for example, by a separate element. It is preferred, however, to make these two functions with one element. The guide is also not necessarily parallel to the eccentric shaft. With a curved progression, different "deflections" of the guided oscillating rockers can be achieved.

Preferably, the oscillating rockers are placed on the eccentric. In this way, it can be achieved that the oscillating rockers not only generate a forward and backward movement, but also a continuation and/or migration of the massage device is achieved over the tissue to be massaged.

Preferably, in the process it is also proposed to provide a carrying device that runs parallel to the extension direction of the oscillating rockers and thus in their movement direction, on which the massage device can then be guided along.

It can be planned to provide this carrying device with a shoulder strap. In this way it can be achieved that a massage device constructed in this way is set by a user himself/herself onto his/her back. Using the shoulder strap, the device on the carrying device is hung by the user on his shoulders while standing and when the user lies down on his stomach, the massage device is in the proper position over his back in order to perform the desired massage and in the process work its way forward along the back.

In order to be able to massage the back well over its entire width, massage cams can be arranged on an arched surface. This is also to be achieved, for example, in that the guide and/or the eccentric shaft are themselves flexible, in order to make possible a corresponding adaptation of the massage device onto one and/or different bodies. The flexibility of the eccentric shaft is, in the process, achieved by cardan and/or universal joints.

It is also, however, in the context of the invention to shape the oscillating rockers differently or to provide the massage cams with different lengths.

BRIEF DESCRIPTION OF THE SEVERAL VIEWS OF THE DRAWINGS

Additional advantages and characteristics of the invention arise from the following description of an embodiment example.

DETAILED DESCRIPTION OF THE INVENTION

Figure 1:
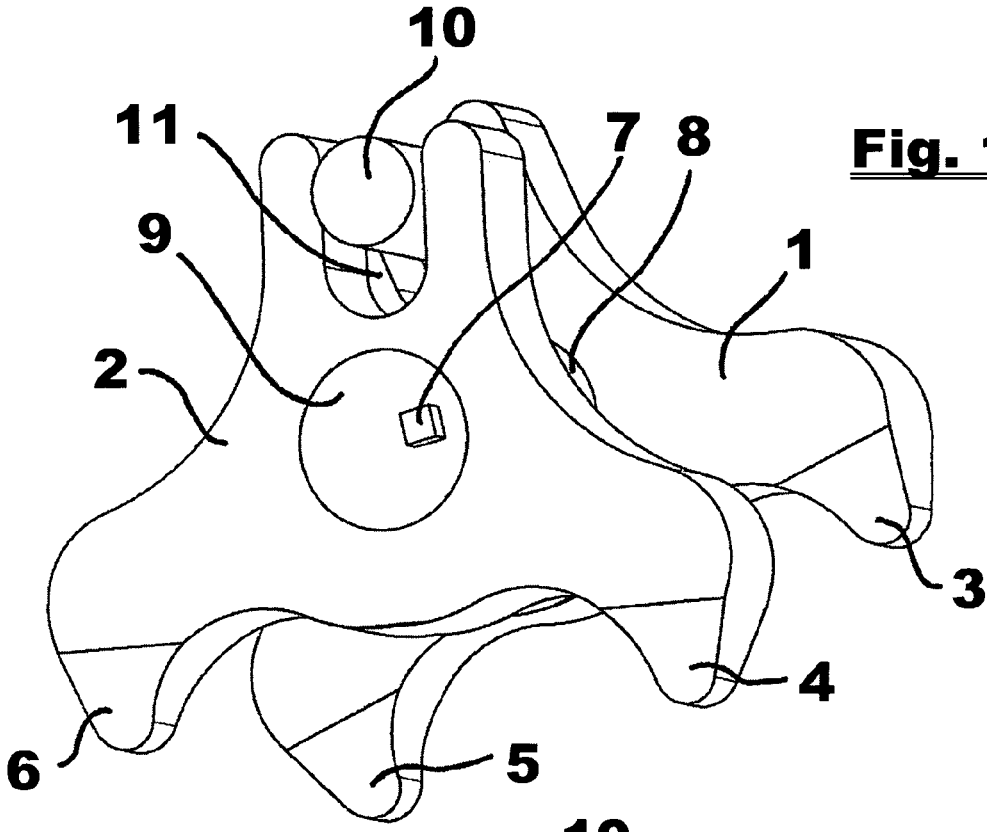
FIG. 1 is a perspective view of a pair of oscillating rockers, arranged next to each other, of the massage device.

In FIG. 1, there are two oscillating rockers 1, 2, arranged next to each other, of massage device. Each of these oscillating rockers, which can be made of wood, plastic or even also out of metal, has two massage cams 3 to 6, whereby they each have a U-shaped basic form. The massage cams 3 to 6 are respectively arranged on the ends of the legs of the U-shaped body. The cams can in the process, be molded either as a single piece on the U-shaped oscillating rocker or instead are formed as separate elements, for example, out of (hard) rubber or wood, etc. and then set on the oscillating rocker.

The oscillating rockers are set down in the example shown here with their middle region, which corresponds to the base of the U, onto an eccentric shaft 7. In the process, the eccentrics 8, 9 of the eccentric shaft are mounted offset from each other by 180° on the eccentric shaft 7 in the example shown here, so that the oscillating rockers 1 and 2 are driven in a phase-shifted manner from each other when the eccentric shaft 7 rotates. A shift of 180°, as described here, is considered to be optimal in the process. However, the desired effects can also be achieved with other offset angles.

In the example shown here, a rod-shaped guide 10 runs parallel to the eccentric shaft 7 and is grasped by the oscillating rockers 1, 2 with a fork-shaped receptacle 11. With a curved progression of the guide (not shown here), a variable excursion of the oscillations is achieved, which can lead to changeable massage effects over the width of the massage device.

Figure 2:
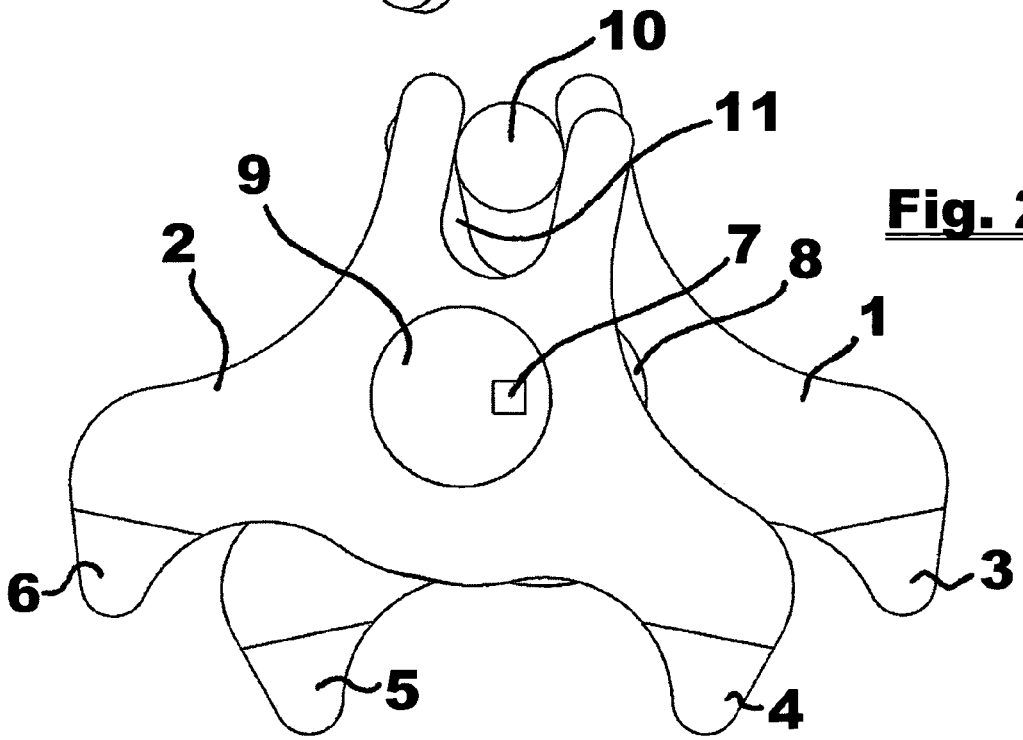
FIG. 2 is a side view of a pair of oscillating rockers, arranged next to each other.

In FIG. 2, the pair of oscillating rockers arranged next to each other and described using FIG. 1 is shown from a side view, whereby the device is oriented facing to the front coming from the working direction and/or direction of movement.

In FIG. 3, the movement progression of the pair of oscillating rockers shown in FIG. 2 can be recognized over a rotation of the eccentric shaft of 360°.

In FIG. 3, the front eccentric 9 is in its maximum lower position, which means that the adjacent eccentric 8 offset by 180° is in its maximum upper position. This means at the same time that the oscillating rockers 2 and 1 sitting on these eccentrics are in their greatest lowered and/or greatest raised positions.

Figure 3B:
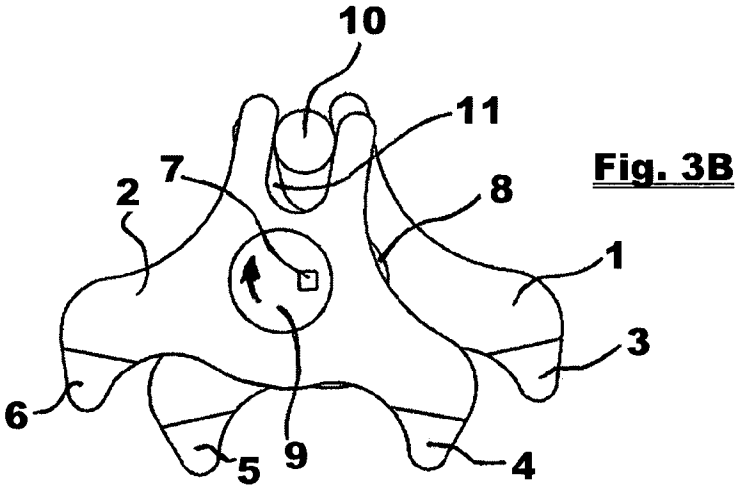
FIG. 3 shows plan views (a–d) of the movement cycle of a pair of oscillating rockers arranged next to each other.
Figure 3D:
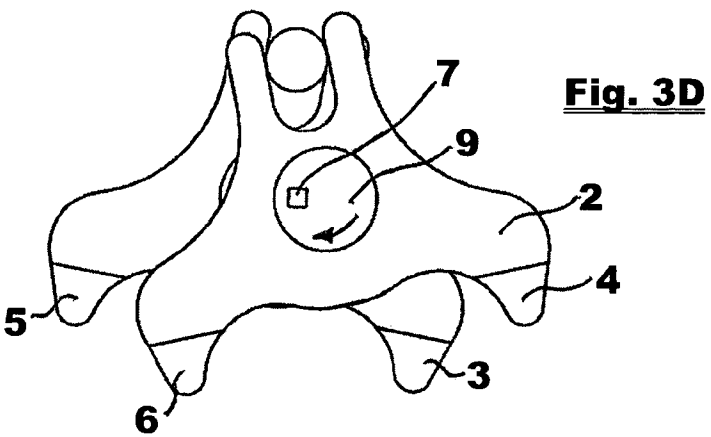
Figure 3A:
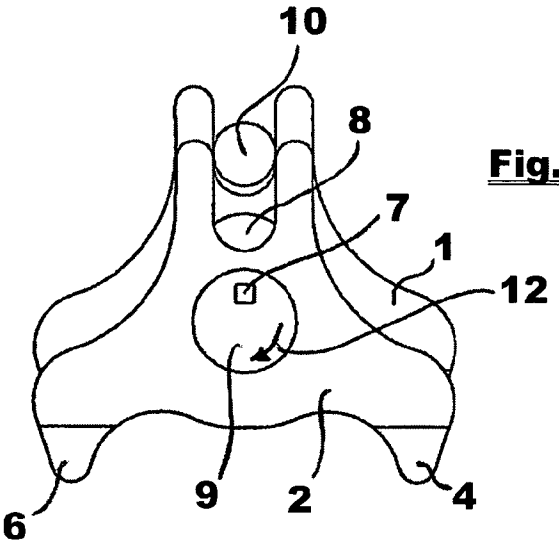

Between FIG. 3A and FIG. 3B, the eccentric shaft 7 turns according to the arrow 12 by 90° in the clockwise direction. Since the guide 10 sitting above the eccentric shaft 7 does not change its position in the process, the front-sitting oscillating rocker 2, which surrounds the guide 10 by its receptacle 11, fork-shaped in this example, is pivoted to the left in the drawing shown, whereby the massage cam 6 is raised, while the massage cam 4 is lowered and thus at the same time is moved to the left. Since by the rotation of the eccentric shaft 7, the eccentric 8, on which the other oscillating rocker 1 sits, is rotated by 90° at the same time, the oscillating rocker 1 (lying behind in the drawing shown here) is simultaneously pivoted to the right. Since this oscillating rocker 1 also surrounds with its receptacle 11 the guide 10 that is fixed in its position, the massage cam 3 is raised in the process for the oscillation rocker 1, while the massage cam 5 is lowered and moved to the right.

Between the massage cams 4 and 5, a movement towards each other occurs, whereby the tissue lying between these cams is grasped and is kneaded correspondingly.

Figure 3C:
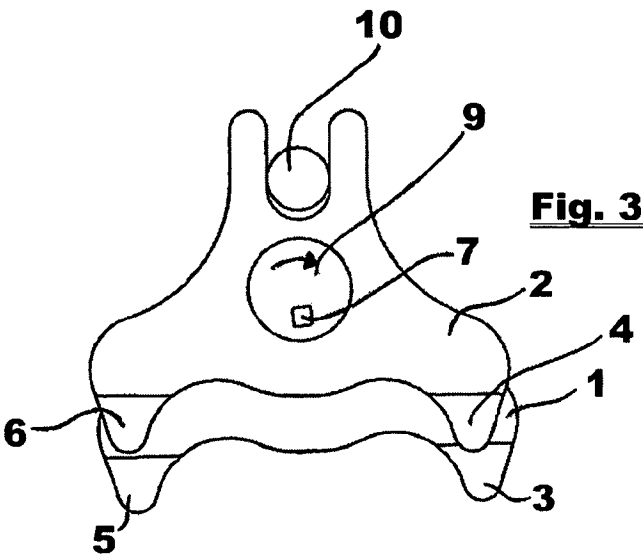

In the further progression of the rotation of the eccentric shaft 7, as is shown in FIG. 3C, the eccentric 9 is brought into its highest position and thus the oscillating rocker 2 is lifted. At the same time, the oscillating rocker 1 is pressed downwards, so that it is lowered with the cams 3 and 5 to the tissue to be massage by it. In this way, for an additional rotation of the eccentric shaft 7, the oscillating rocker 2 is shifted to the right relative to the oscillating rocker 1 that now sits on the tissue to be massaged. Thus, the pair of oscillating rockers described here finally migrates to the right in the plane shown here.

In a further rotation of the eccentric shaft 7, the oscillating rocker 2 is moved via the eccentric shaft 9 fully to the right, whereby the massage cam 6 is lowered, as shown in FIG. 3D.

In a further pivoting of the eccentric shaft 7, in order to be able to get again into the position as is shown in FIG. 3A, the massage cams 6 and 3 located on the adjacent oscillating rockers move apart, whereby the tissue located between them is stretched again and/or goes into the non-compressed condition.

It can thus be recognized that with a device of this construction type, the tissue is pressed together alternatingly and then stretched, which corresponds to a pronounced intensive kneading and thus to a very good massaging action.

If in the process, between adjacent oscillating rockers, angles deviating by 180° are planned for the eccentric driving them, greater and weaker massage movements of the tissue are performed in an alternating manner.

Figure 4:
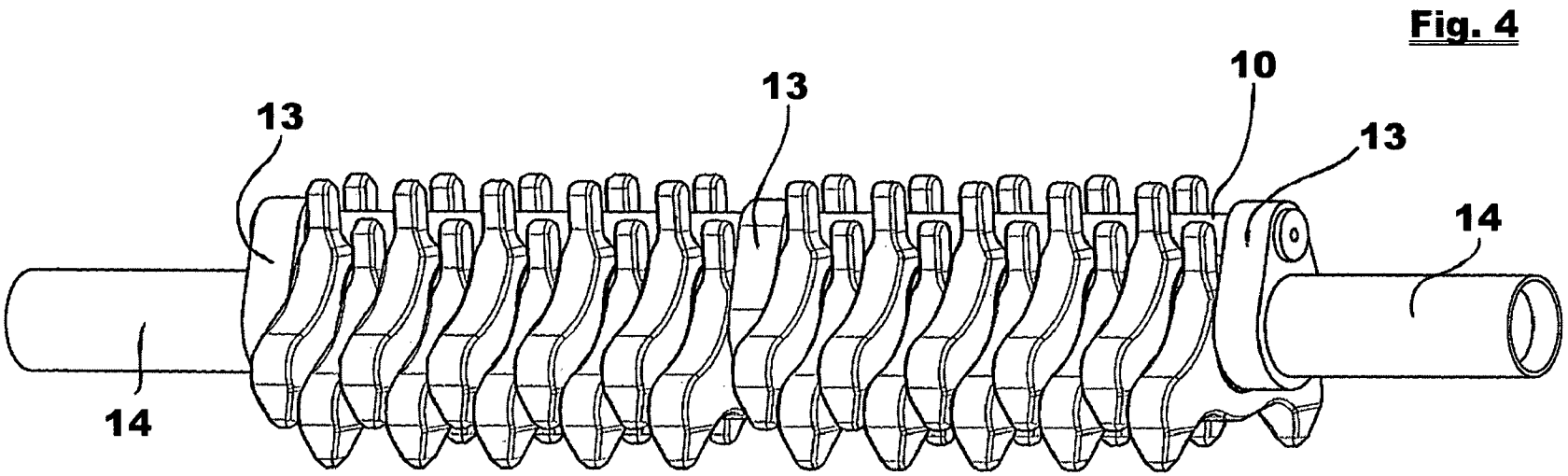
FIG. 4 is a perspective view of a device with numerous oscillating rockers arranged next to each other.

In FIG. 4, a corresponding massage device with a multitude of oscillating rockers arranged next to each other is depicted. It can be recognized that the guide 10 has bearing elements 13 on its ends and in its center, which extend to the bottom from the guide 10 in the example shown here. On the lower end of these bearing elements 13, the eccentric shaft 7 (blocked here) is set, and it is driven by one or two electric motors, which in the example depicted here are inserted in operating handles 14, which are in an axial extension of the eccentric shaft 7. Via these operating handles 14, a manual guidance of the massage device can also be performed. Fundamentally, of course, both the motors and the operating handles can be provided at any desired other points which will readily occur to the professional.

At this point it should also be mentioned that the guide 10 can also be formed by a U-shaped rail, of course, into which the oscillating rockers then grasp with corresponding fingers.

Of course, it is also possible to set the oscillating rockers themselves in bearings not on the eccentric shaft, but instead on the guide. In this case, the eccentric shaft would merely cause a backwards and forwards swinging of the oscillating rockers, though, and not their lifting up and setting down at an adjacent site.

Also, the receptacle 11 (shown in the example here in a fork shape) can be made of a longitudinal hole.

For the sake of completeness, it must also be pointed out that the oscillating rockers can also only be constructed as longitudinal fingers, for example, whose ends provided with the massage cams move through the movement towards and away from each other as described above.

Figure 5:
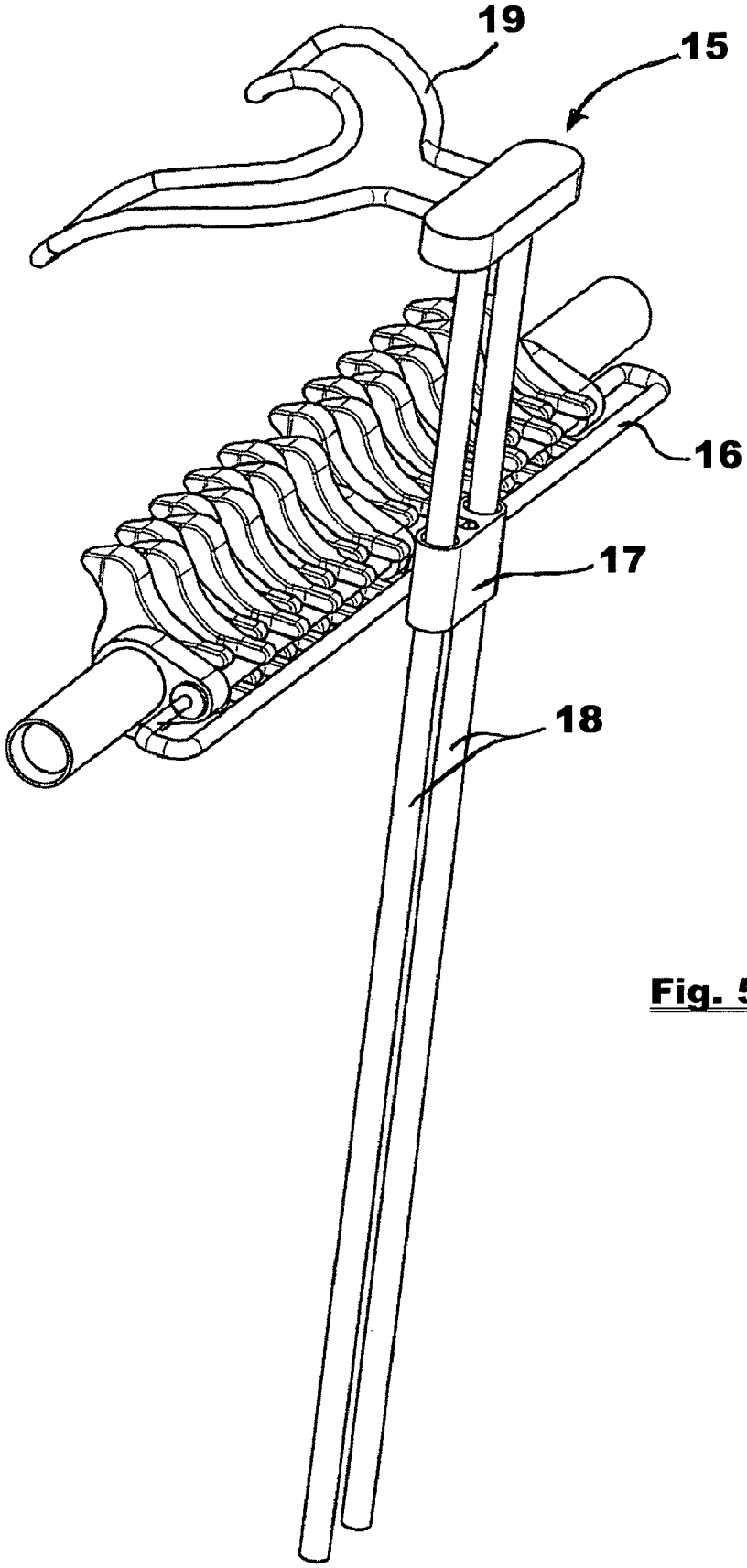
FIG. 5 is another perspective view of a device according to FIG. 4 mounted on a carrying device.

The massage device depicted in the FIG. 4 can, as can be recognized in FIG. 5, also be provided with a carrying device 15. In this carrying device 15, the device shown in FIG. 4 is coupled via a mounting strap 16 to a guide shoe 17, which sits on two guide rods 18 of the carrying device 15 which run parallel to each other. Instead of two parallel guide rods, for example, an elliptic or otherwise-shaped rod shape is in the context of this invention.

While the device is in operation, as was described in FIG. 3 above, the massage device operates along the guide rods 18 with the steps occurring during massaging and can be guided over the back of a person to be massaged in this way.

So that this person can position the carrying device 15 properly on his/her back, a shoulder strap 19 is mounted on the upper end of the carrying device 15. By this, the device is hung in its resting position on the shoulders of the person to be massaged and if this person then lies on his/her stomach, an exact orientation of the massage device is achieved if the guide rods run essentially parallel to the spine of the person to be massaged.

It should also be mentioned that the guide rods 18 are to be provided with stoppers on their ends which act on a throw-over switch in the guide shoe 17. Thus, when the guide shoe 17 hits a stopper, the drive of the massage device can then occur via this throw-over switch in the opposite direction, whereby massaging of the back is possible in sequence several times in variable directions.

In the example shown here, the massage cams are essentially on a flat surface. However, it is also possible to design the eccentric shaft and the guide flexibly whereby the massage cams come to lie on an arched surface and thus can be fitted to the back of a person who is to be treated. The eccentric shaft would thus, for example, be designed in a corresponding flexible manner via a multitude of universal joints.

I claim:

1. A massage device comprising:

a pair of oscillating rockers each having an end, each oscillating rocker of said pair of oscillating rockers being connected to an eccentric shaft, said eccentric shaft being disposed between said pair of oscillating rockers, said pair of oscillating rockers each having a U-shape;

a first pair of massaging cams positioned at said end of one of said oscillating rockers;

a second pair of massaging cams positioned at said end of the other oscillating rocker, said first pair of massaging cams being adjacent said second pair of massaging cams;

a guide received by said pair of oscillating rockers, said guide extending in spaced relation to and parallel to said eccentric shaft, said guide positioned on another end of said pair of oscillating rockers opposite said first pair and said second pair of massaging cams, each of said first pair and second pair of massaging cams having a U-shape and positioned below said eccentric shaft and guide, said eccentric shaft being disposed between said massaging cams and said guide, said oscillating rockers disposed below said guide; and a driving means connected to said eccentric shaft for driving said first and second pairs of massaging cams offset in phase from each other.

2. The massage device of claims 1, said eccentric shaft having a first eccentric and a second eccentric thereon, said one of said oscillating rockers being set on said first eccentric, the other of said oscillating rockers being set on said second eccentric.

3. The massage device of claim 1, further comprising:

a carrying device connected to said pair of oscillating rockers, said carrying device extending parallel to the oscillating direction of said pair of oscillating rockers.

4. The massage device of claim 3, said carrying device having a shoulder strap at one end thereof.

5. The massage device of claim 1, said guide and said eccentric shaft being flexible.

* * * * *